US012601568B2

(12) United States Patent
Ross

(10) Patent No.: US 12,601,568 B2
(45) Date of Patent: Apr. 14, 2026

(54) BALLISTIC BODY ARMOR JACKET CARRIER WITH BREAKAWAY POCKETS AND A METHOD OF SECURING AND CONCEALING ARMOR PLATE PANELS IN JACKETS

(71) Applicant: Damian Ross, Saddle River, NJ (US)

(72) Inventor: Damian Ross, Saddle River, NJ (US)

( * ) Notice: Subject to any disclaimer, the term of this patent is extended or adjusted under 35 U.S.C. 154(b) by 0 days.

(21) Appl. No.: 17/994,438

(22) Filed: Nov. 28, 2022

(65) Prior Publication Data

US 2024/0175662 A1 May 30, 2024

(51) Int. Cl.

| | |
|---|---|
| ***F41H 5/013*** | (2006.01) |
| ***A41D 1/02*** | (2006.01) |
| ***A41D 27/20*** | (2006.01) |

(52) U.S. Cl.

CPC ..... *F41H 5/013* (2013.01); *A41D 1/02* (2013.01); *A41D 27/20* (2013.01)

(58) Field of Classification Search

CPC ..... A41D 13/0012; A41D 13/015; A41D 13/0151; A41D 13/0575; A41D 1/02; A41D 27/20; F41H 5/013

See application file for complete search history.

(56) References Cited

U.S. PATENT DOCUMENTS

| | | | | |
|---|---|---|---|---|
| 4,507,802 | A * | 4/1985 | Small | F41H 1/02 2/2.5 |
| 5,584,737 | A * | 12/1996 | Luhtala | F41H 1/02 2/2.5 |
| 9,009,870 | B1 * | 4/2015 | Connick, Jr. | A41D 27/20 2/252 |
| 2007/0234459 | A1 * | 10/2007 | Stewart | F41H 1/02 2/2.5 |
| 2017/0082404 | A1 * | 3/2017 | Blauer | F41H 1/02 |
| 2019/0098948 | A1 * | 4/2019 | Studinger | A41D 1/02 |
| 2023/0145266 | A1 * | 5/2023 | Pittman | A41D 13/0518 2/2.5 |

* cited by examiner

*Primary Examiner* — Haley A Smith

(57) ABSTRACT

A ballistic panel carrier jacket is disclosed. The jacket of this invention comprises a front section and a back section. The back section has a back pocket attached thereto having an opening for receiving a back ballistic panel. The front section has a plurality of front pockets attached thereto having a housing pouch for receiving a front ballistic panel and a receiving pocket for receiving and securing the pouch of the front ballistic panel such that the front right and front left pockets interact with one another such that a section of one is received within another. The carrier jacket of the present invention also discloses a false pocket breakaway section that functions as a Hidden Draw System (HDS) that allows a user access their firearm legally from the holster, quickly and discreetly.

3 Claims, 6 Drawing Sheets

BALLISTIC BODY ARMOR JACKET CARRIER WITH BREAKAWAY POCKETS AND A METHOD OF SECURING AND CONCEALING ARMOR PLATE PANELS IN JACKETS

FIELD OF INVENTION

The invention relates to ballistics jacket and more particularly to a method of securing a front and back armor plate onto a carrier jacket such that the front pocket is secured across the chest and midsection in an opposite pocket called the receiving pocket.

BACKGROUND OF INVENTION

A bulletproof vest, also known as a ballistic vest or a bullet-resistant vest, is an item of body armor that helps absorb the impact and reduce or stop penetration to the torso from firearm-fired projectiles and fragmentation from explosions. The vest may come in a soft form, as worn by many police officers, prison guards, security guards and some private citizens. Prison guards and police may wear soft vests designed to resist stabbing attacks, using metallic or para-aramid components. Soldiers, SWAT teams, marines and special operations forces wear hard armors, either in conjunction with soft armor or alone. This allows for protection against rifle ammunition or fragmentation. A ballistic plate, also known as an armor plate, is a protective armored plate inserted into a carrier or bulletproof vest, that can be used stand-alone, or in conjunction with other armor. "Hard armor" usually denotes armor that uses ballistic plates. It serves to defeat higher threats, and may be considered as a form of applique armor. It is usually inserted into the front and back, with side inserts also sometimes used.

Usually, a vest contains two armor plates and trauma pads held in place by a carrier. One panel protects the front of the torso, the other protects the rear. When a person desires to use the armored vest, he or she inserts the armored plate into the carrier vest pouch or pockets at the front and at the rear. The known method of concealing and securing armored plates into the carrier vest jackets is by placing them inside the carrier jackets in the front side and at the rear.

Prior arts show quick release/quick access conceal carry mechanisms, configurable for left and right-handed users, removable bulletproof plates, etc. Conventional designs lack the functionality of a dual-pocket system where one pocket is inserted into another for enhanced concealment and secure placement. This invention overcomes these limitations by providing an innovative configuration of storage and receiving pockets for armor plates.

SUMMARY OF INVENTION

The following summary discloses all the features and functions of the present Invention, by considering the whole specifications, claims, drawings and abstract, one can easily get a full understanding of the invention and it functions.

The invention is a ballistic body armor carrier jacket comprising of dual front pockets, which includes a storage pocket, a receiving pocket and a rear pocket for securing armor plates. The front storage pocket is inserted into a receiving pocket when in use. The receiving pocket features a reinforcement strap to hold the armor securely across the chest and midsection. The carrier jacket further features breakaway front hand pockets configured to enable a user deploy their hands directly from a secret position. The rear pocket located in the back of the jacket, is designed to hold the rear protective panel securely using at least one fastening means, the fastening means is at least one fastening strip, zippers, hook-and-loop fasteners (commonly referred to as Velcro®), magnets, snaps, or a threaded loop system. Similarly, the front protective panel is stored within the front storage pocket located in the chest/midsection of the jacket. The front receiving pocket for the front panel, is situated directly opposite the front storage pocket, and reinforced using at least one fastening means, the fastening means is at least a fastening strip, zippers, hook-and-loop fasteners (commonly referred to as Velcro®), magnets, snaps, or a threaded loop system to hold the armor firmly across the chest and midsection.

Additionally, the jacket includes partial breakaway front hand pockets that are held in place with snaps, magnets or hook and loop fasteners. From an external perspective, these breakaway pockets appear to be normal jacket pockets. However, said breakaway pockets are false pockets that allow the user to have clear access to any item in their front pocket or attached to their belt or waistband. This will give the appearance of the user having their hands in their pockets while they are securing a concealed item like a firearm or pepper spray. When the user deploys that concealed item, the fasteners will break away, enabling the user to deploy their hands directly from a concealed position.

The front lower right and left sections of the jacket are configured as a false pocket allowing internal access to a waistband-positioned item that allows a user to access a waistband-positioned holstered item, such as a firearm or pepper spray, without revealing the user's hand movement prior to deployment. The breakaway mechanism enables the user to deploy their hands directly from the "concealed position". "In the front lower sections of the jacket, breakaway panels are configured as false pocket overlays at the waistband region. These overlays use standard fastening means (e.g. snaps, magnets, or hook-and-loop) and are such that, when partially released, a hand may pass through and access a holstered item without exposing external hand movements.

One object of the present invention is to provide a different method of securing and or concealing ballistic panels in clothing and carrier vest jackets. The front storage pocket features an inner pouch that is deployed to receive the armored plate and is further stored in a receiving pocket in the interior of the jacket. The receiving pocket for the front panel is situated directly opposite the storage pocket, the receiving pocket is reinforced with a strap to hold the armor firmly in place when the jacket is closed. Additionally, the jacket includes partial breakaway front hand pockets that are held in place with snaps, magnets, or hook-and-loop fasteners. From an external perspective, these breakaway pockets resemble conventional jacket pockets. However, they are configured to provide the user with immediate access to items secured in the waistband or attached to the belt. This design allows the user to maintain the appearance of having their hands in their pockets while discreetly securing or deploying concealed items, a firearm or pepper spray. When the concealed item is deployed, the fasteners disengage, enabling the user to retrieve the item directly from a concealed position.

DETAILED DESCRIPTION OF FIGURES

Figure 1:
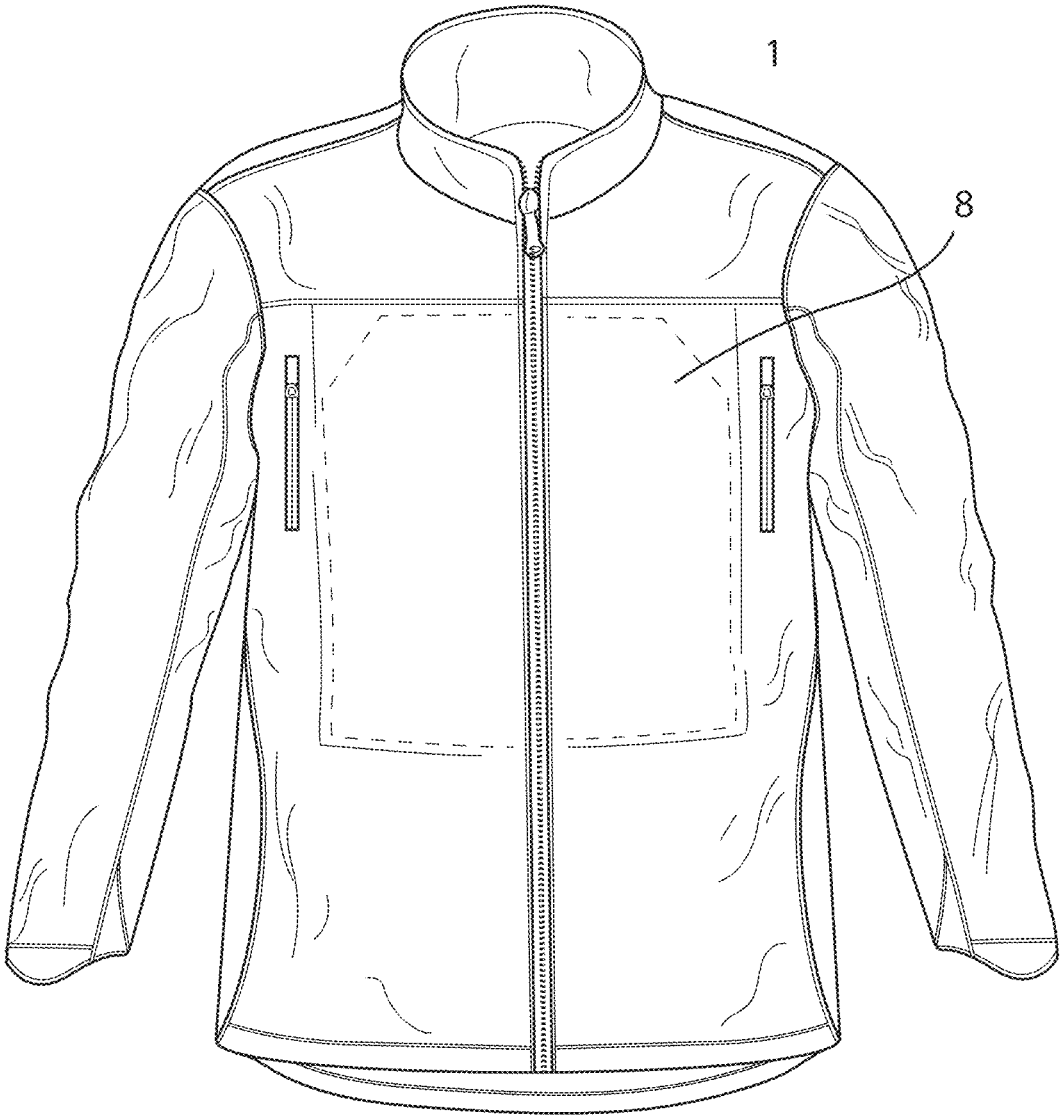
FIG. 1, is a Front view of the carrier jacket.

FIG. 1, discloses a carrier jacket (1) and further reveals the front section which comprises of the front storage pocket section housing the front ballistic plates (8). The broken lines are for illustration purposes and is used to show the ballistic plates inside the front pockets.

Figure 2A:
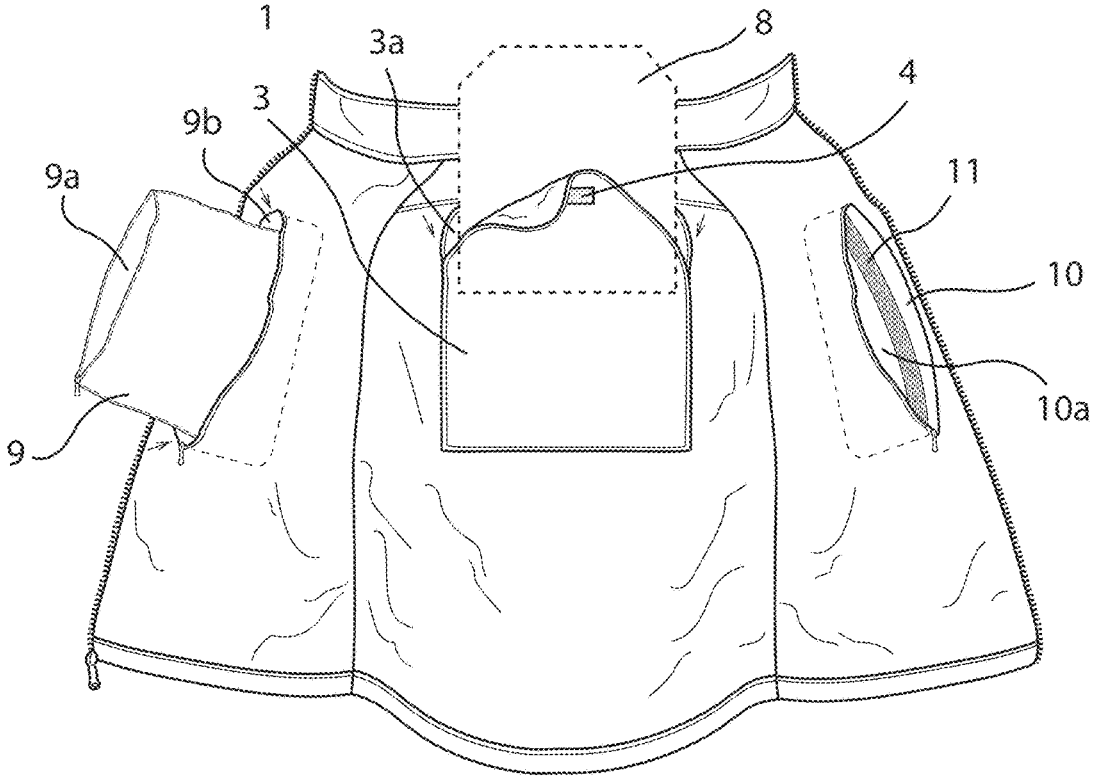
FIG. 2*a* is an interior view of the carrier jacket revealing the storage pocket, receiving pocket and the rear pocket.

FIG. 2*a*, discloses the interior section of the carrier jacket (1), revealing the rear pocket (3) with an opening (3*a*) designed for receiving a back armor plate (8) and can be further secured close preferably with a fastening means (4), the fastening means is at least one zipper, hook-and-loop fasteners (commonly referred to as Velcro®), magnets, snaps, or a threaded loop system. The front section comprises of a front storage pocket (9*b*) and front receiving pocket (10). The front storage pocket (9*b*) is configured with an inner pouch (9), an opening (9*a*) to receive the front armor plate (8) and further secured within preferably with a fastener, said fastener is preferably a zipper (17). The front receiving pocket (10) of the jacket is configured to receive the pouch (9) of the said front storage pocket, the pouch (9) containing the front armor plate (8) is then secured across the chest section of the user of the jacket so that the front pockets interact with one another in a manner where a section of one is received within another. The broken lines are for illustration purposes and is used to show the ballistic plates inside the pockets and the depression of the pockets.

Figure 2B:
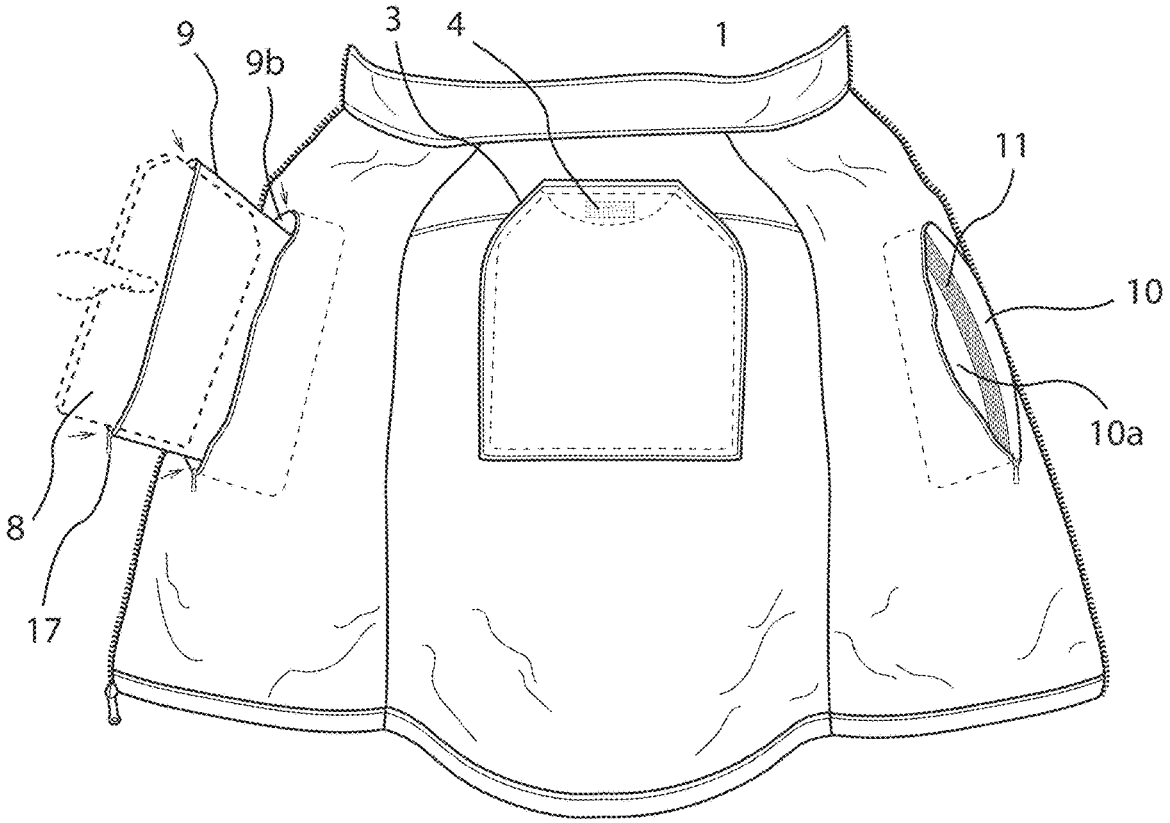
FIG. 2*b* is an illustrative view of the carrier jacket showing the front storage pocket receiving the armor plate.
Figure 3A:
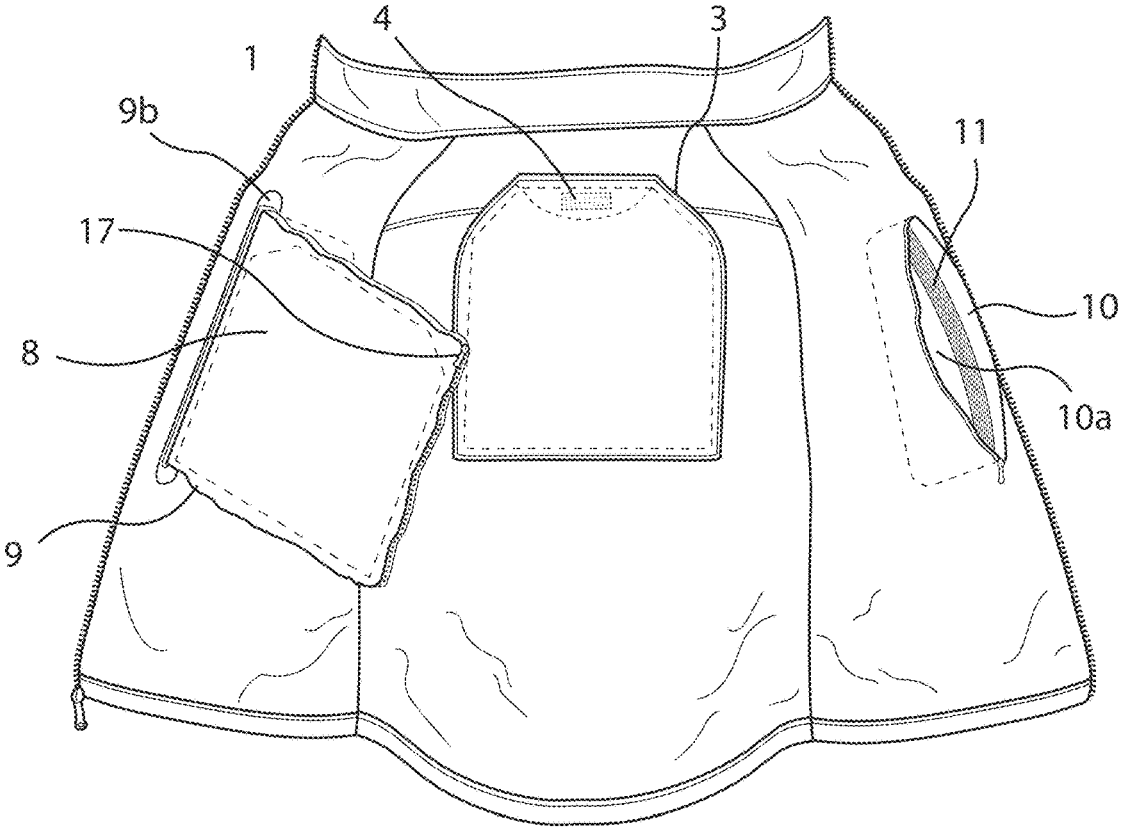
FIG. 3*a* is an illustrative view of the carrier jacket with the armor plate securely stored in the pouch of the front storage pocket and revealing the receiving pocket, and rear pocket.

FIG. 2*b*, discloses the interior view of the armor plate carrier jacket (1) revealing the rear pocket (3) closed, the front storage pocket (9*b*), the inner pouch (9) is deployed out from the front storage pocket (9*b*) to receive the front armor plate (8) and is further secured within with a fastener, said fastener is preferably a zipper (17) revealing the manner in which it may be adapted and secured to receive the front armor plate. The front section of the carrier jacket (1) further discloses the front receiving pocket (10), an opening (10*a*) for receiving the armor plate housed inside the pouch (9), so that the pouch is received inside the front receiving pocket (10) and adapted to receive and secure the front panel (8) preferably with at least one fastening means, said fastening means is at least a fastening strip. FIG. 3*a*, discloses the pouch (9) of the storage pocket housing the armor plate (8) having been deployed from the front storage pocket (9*b*), and secured preferably with a zipper (17). The broken lines are for illustration purposes and is used to show the ballistic plates inside the pockets and the depression of the pockets.

Figure 3B:
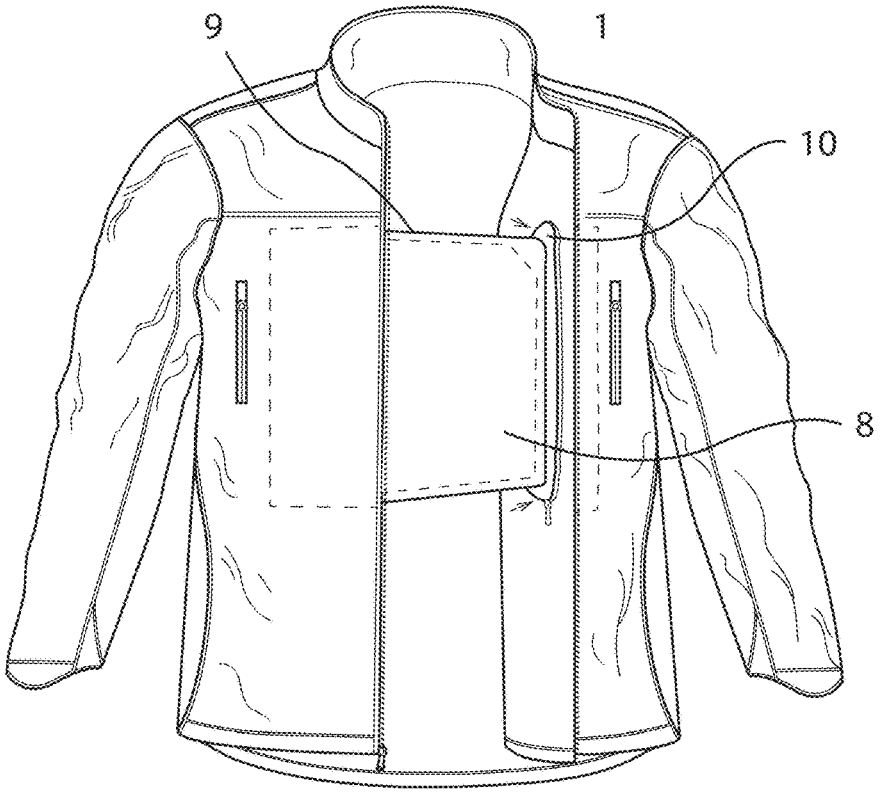
FIG. 3*b* is a front side view of the carrier jacket revealing the interaction of the front storage pockets with the receiving pocket such that the inner pouch portion of one is "received" within another
Figure 4:
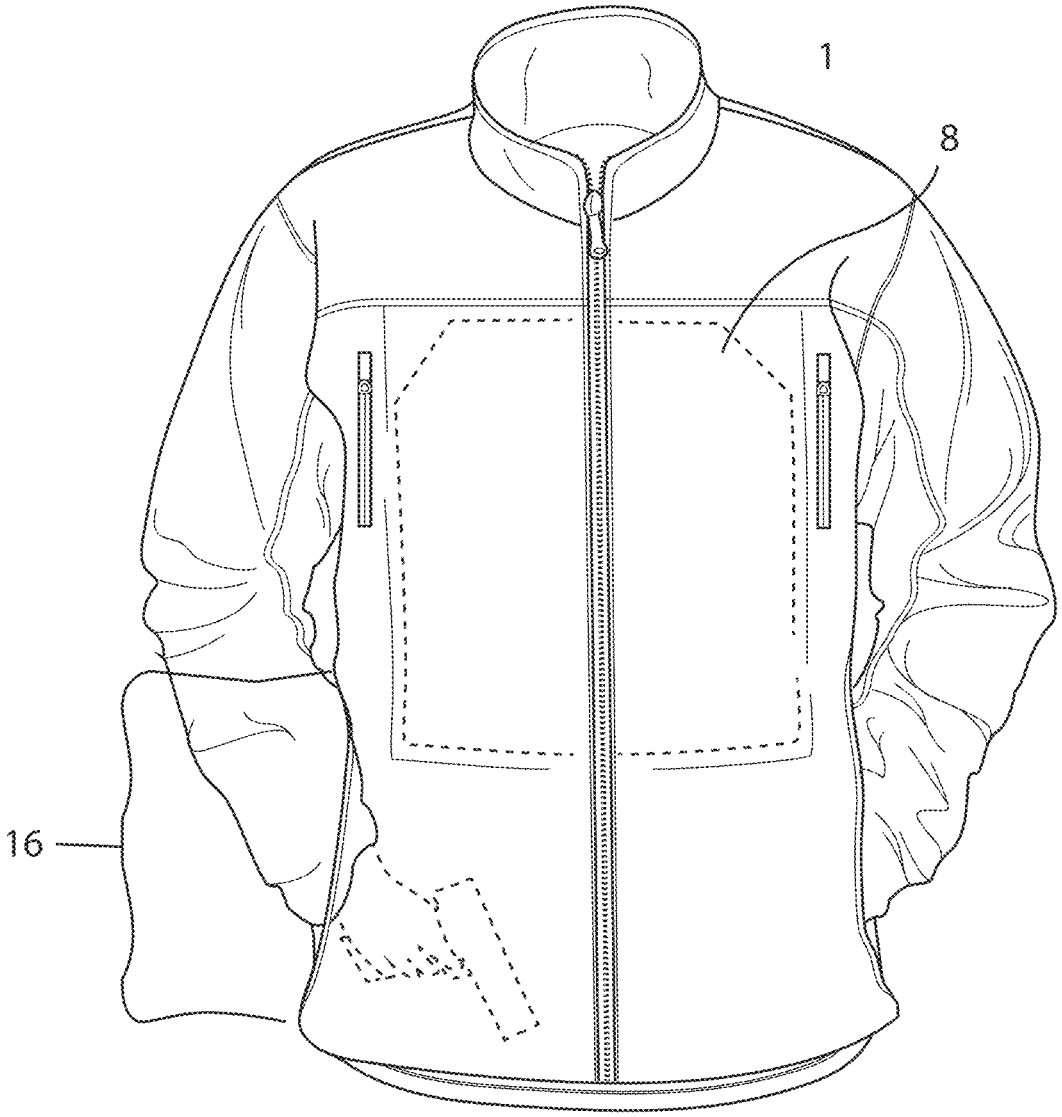
FIG. 4 is a front side view of the carrier jacket revealing the interaction of a user's hand with the breakaway section.

FIG. 3*b* is a front elevational view of the armor plate carrier jacket, illustrating the front section partially opened and reveals the interaction between the pouch of the storage front pockets (9) and the receiving pocket (10), where a portion of one pocket is designed to fit within another, accommodating and securing the ballistic front panel (8). FIG. 4, provides a front elevational view of the armor plate carrier jacket 1, as depicted in FIGS. 2 and 3, with the front section fully closed, highlighting the secured front armor plate (8) and the breakaway false pocket section (16).

Figure 5A:
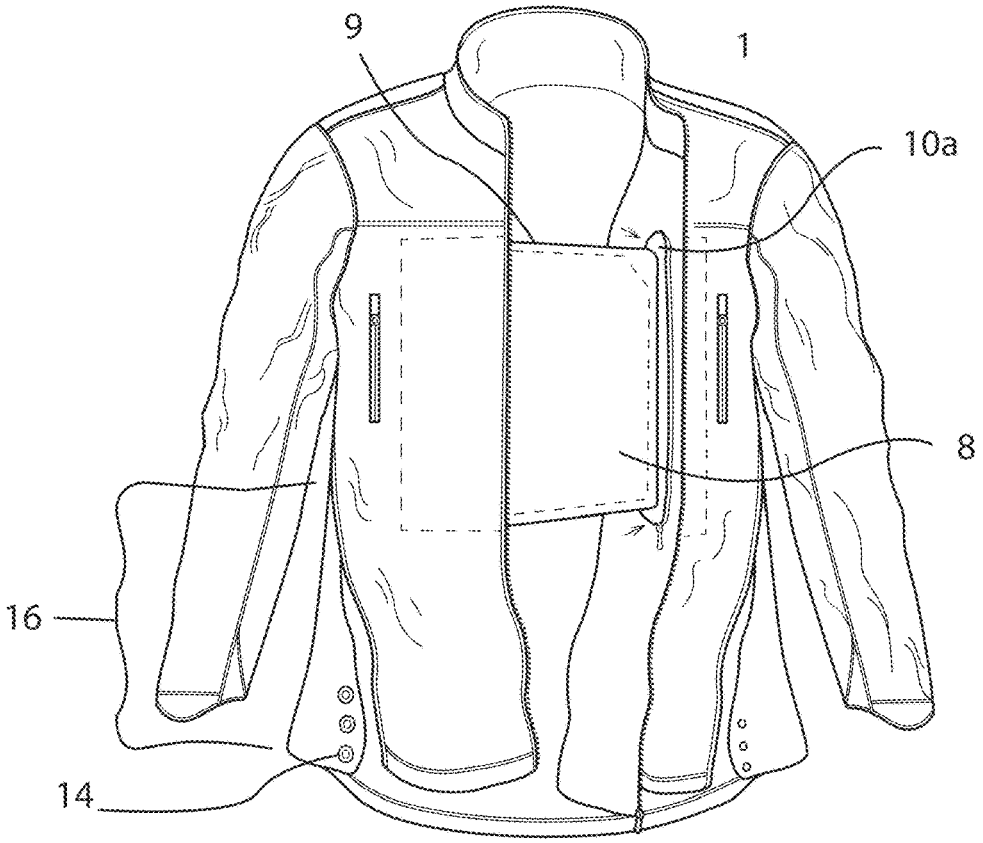
FIG. 5*a* is a front view of the carrier jacket revealing the breakaway section.
Figure 5B:
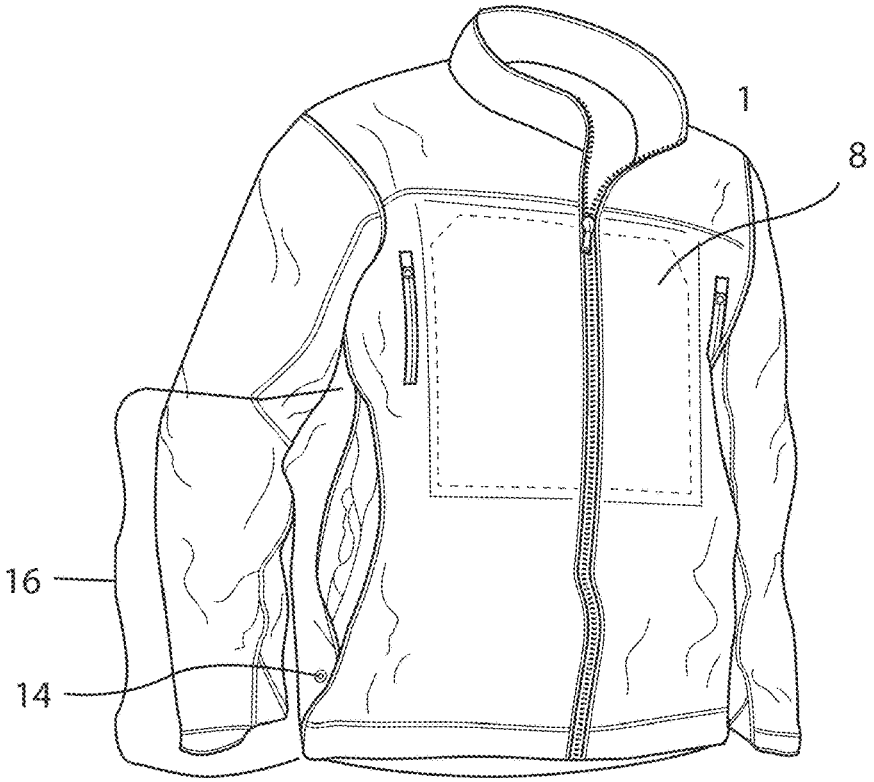
FIG. 5*b* is a front side view of the carrier jacket revealing the breakaway section as a false pocket of the carrier jacket as seen in FIG. 5*a;*

FIGS. 5*a* and 5*b* present front side elevational views of the armor plate carrier jacket 1, as shown in FIGS. 2, 3, and 4. The front section of the jacket is partially opened to demonstrate the interaction between the pouch of the front storage pocket (9) been received through the opening (10*a*) of the receiving pocket, the carrier jacket 1 further reveals the breakaway false pocket section (16), the breakaway false pocket section can be further secured close preferably with a fastening means (4), the fastening means is at least a zipper, hook-and-loop fasteners (commonly referred to as Velcro®), magnets, snaps, or a threaded loop system.

Figure 6:
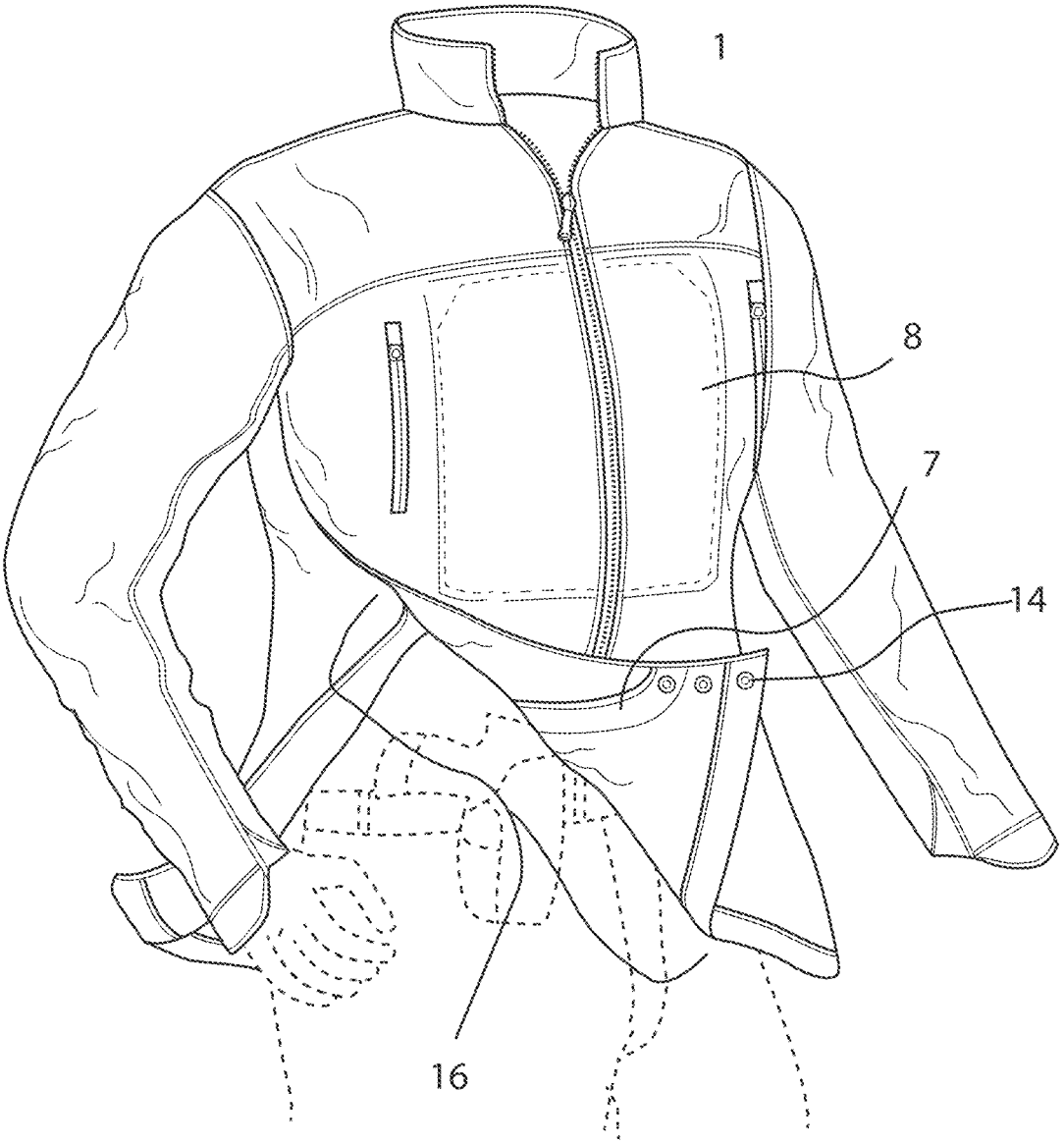
FIG. 6, illustrates afront-side elevational view of the armor plate carrier jacket, as depicted in FIGS. 1, 3, 4 and 5 with the front section of the jacket fully closed revealing the breakaway section and false pocket.

FIG. 6, illustrates afront-side elevational view of the armor plate carrier jacket 1, as depicted in FIGS. 1, 3, 4 and 5. The front section of the jacket is shown fully closed, with the breakaway section (16) completely detached and revealing the false pocket (7).

What is claimed is:

1. A ballistic body armor jacket carrier with a breakaway section comprising: a front portion, a rear portion, the front portion including a first side panel, a second side panel, and a fastener configured to releasably attached the first side panel and the second side panel; a rear pocket disposed in the rear portion, wherein the rear pocket has an opening (3*a*) disposed at the top of the rear pocket, the opening configured to receive a back armor plate (8) and wherein the rear pocket opening is secured close with a fastening means (4), the fastening means comprising one of a zipper, hook-and-loop fasteners, magnets, snaps, or a threaded loop system; a front storage pocket (9*b*) disposed on the first side panel; a pouch disposed on the first side panel and disposed attached to and configured to be stowable within the front storage pocket (9*b*), the pouch comprising an opening disposed on a distal end of the pouch furthest from the front storage pocket, for the pouch and the front storage pocket configured to receive a front armor plate through the opening, the front armor plate extending across both the front storage pocket and the pouch, a front receiving pocket (10) disposed on the second side panel, wherein the front receiving pocket includes: an opening (10*a*), the opening configured to receive the pouch and the portion of the front armor plate (8) that is disposed within the pouch, and is secured close with a fastening means, wherein the fastening means is a leather material, fastening snaps, or a threaded loop system, and a breakaway section (16), comprising of a false pocket section (7), wherein the breakaway section is secured close with a fastening means, wherein the fastening means is one of a zipper, hook-and-loop fasteners, magnets or snaps.

2. The ballistic body armor carrier jacket of claim 1, wherein the breakaway section comprises a false front pocket disposed in the lower front portion of the jacket and secured with a fastening means selected from zippers, hook-and-loop fasteners, magnets, snaps, or a threaded loop system, the false pocket being positioned to overlay the waistband region of the user, therein being configured to allow internal access through the pocket opening to an area adjacent the wearer's waistband, without requiring outward hand movement beyond the jacket's profile.

3. A method for securing and concealing a ballistic panel within a jacket, comprising: Forming a jacket with a front storage pocket (9*b*) and a front receiving pocket (10), the front storage pocket (9*b*) containing an inner pouch (9) configured to receive and hold a ballistic panel (8) within the pouch, the pouch comprising an opening disposed on a distal end of the pouch furthest from the front storage pocket, wherein the ballistic panel (8) is fully enclosed in the pouch (9) while the pouch (9) remains inside the front storage pocket (9*b*), inserting the portion of the ballistic panel (8) that is held within the pouch (9), together with the entire pouch (9), into the front receiving pocket (10) through an opening (10*a*) of the front receiving pocket, securing the pouch (9) containing the ballistic panel (8) inside the front receiving pocket (10) with a fastening strip (11), wherein the front storage pocket (9*b*), pouch (9), and front receiving pocket (10) cooperatively retain the ballistic panel (8) in a layered, concealed configuration across the chest and mid-section of the wearer.

* * * * *